US009675105B2

(12) United States Patent
Sakai

(10) Patent No.: US 9,675,105 B2
(45) Date of Patent: Jun. 13, 2017

(54) MENTHOL-SORBED ACTIVATED CHARCOAL, CIGARETTE FILTER, AND FILTER-TIPPED CIGARETTE

(71) Applicant: JAPAN TOBACCO INC., Tokyo (JP)

(72) Inventor: Yoshinori Sakai, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 15/083,799

(22) Filed: Mar. 29, 2016

(65) Prior Publication Data

US 2016/0205997 A1 Jul. 21, 2016

Related U.S. Application Data

(60) Division of application No. 13/865,381, filed on Apr. 18, 2013, now abandoned, which is a continuation of (Continued)

(30) Foreign Application Priority Data

Oct. 20, 2010 (JP) ..... 2010-235577

(51) Int. Cl.
*A24B 15/30* (2006.01)
*A24D 3/06* (2006.01)

(Continued)

(52) U.S. Cl.
CPC ..... *A24D 3/061* (2013.01); *A24C 5/47* (2013.01); *A24D 3/0287* (2013.01); *A24D 3/14* (2013.01); *A24D 3/163* (2013.01)

(58) Field of Classification Search
None
See application file for complete search history.

(56) References Cited

U.S. PATENT DOCUMENTS 3,236,244 A * 2/1966 Irby, Jr. ..... A24B 15/282 131/274
5,144,967 A 9/1992 Cartwright et al.

(Continued)

FOREIGN PATENT DOCUMENTS

CN 1060773 A 5/1992
DE 691 10 613 T2 2/1996

(Continued)

OTHER PUBLICATIONS

Official Action issued in corresponding European Patent Appliction No. 11 834 096.7 of Sep. 24, 2015 (in English) (4 pages).

(Continued)

*Primary Examiner* — Phu Nguyen
(74) *Attorney, Agent, or Firm* — Birch, Stewart, Kolasch & Birch, LLP

(57) ABSTRACT

Menthol-sorbed activated charcoal stably holding menthol during storage, and smoothly releasing menthol only during passage of tobacco smoke therethrough is provided. The menthol-sorbed activated charcoal is featured in that to activated charcoal having a specific surface area of 1500 $m^2/g$ or more but 1700 $m^2/g$ or less as measured by the BET method, menthol is sorbed at a sorption rate of 80% or more but 92% or less with reference to the saturated amount of menthol for the activated charcoal.

4 Claims, 5 Drawing Sheets

Related U.S. Application Data application No. PCT/JP2011/063835, filed on Jun. 16, 2011.

(51) Int. Cl.

| | |
|---|---|
| ***A24D 3/14*** | (2006.01) |
| ***A24D 3/16*** | (2006.01) |
| ***A24C 5/47*** | (2006.01) |
| ***A24D 3/02*** | (2006.01) |

(56) References Cited

U.S. PATENT DOCUMENTS

| | | | | |
|---|---|---|---|---|
| 2003/0154993 | A1* | 8/2003 | Paine, III | A24D 3/048 131/341 |
| 2004/0226569 | A1 | 11/2004 | Yang et al. | |
| 2007/0003492 | A1 | 1/2007 | Kitahata et al. | |

FOREIGN PATENT DOCUMENTS

| | | | |
|---|---|---|---|
| EP | 0 482 587 | A1 | 4/1992 |
| JP | 4-272298 | A | 9/1992 |
| JP | 2005-518204 | A | 6/2005 |
| JP | 2005-525795 | A | 9/2005 |
| WO | WO 03/059096 | A1 | 7/2003 |
| WO | WO 2004/086888 | A2 | 10/2004 |
| WO | WO 2005/026048 | A1 | 3/2005 |

OTHER PUBLICATIONS

Advisory Action for copending U.S. Appl. No. 13/865,381, dated Feb. 25, 2015.

Advisory Action for copending U.S. Appl. No. 13/865,381, dated Mar. 20, 2015.

Final Office Action for copending U.S. Appl. No. 13/865,381, dated Nov. 21, 2014.

Non-Final Office Action for copending U.S. Appl. No. 13/865,381, dated Apr. 11, 2014.

Non-Final Office Action for copending U.S. Appl. No. 13/865,381, dated Dec. 30, 2015.

* cited by examiner

MENTHOL-SORBED ACTIVATED CHARCOAL, CIGARETTE FILTER, AND FILTER-TIPPED CIGARETTE

CROSS REFERENCE TO RELATED APPLICATIONS

This application is a Divisional of co-pending application Ser. No. 13/865,381, filed on Apr. 18, 2013, which is a Continuation of PCT International Application No. PCT/JP2011/063835, on Jun. 16, 2011, which claims the benefit under 35 U.S.C. §119(a) to Patent Application No. 2010-235577, filed in Japan on Oct. 20, 2010, all of which are hereby expressly incorporated by reference into the present application.

BACKGROUND OF THE INVENTION

Field of the Invention

The present invention relates to menthol-sorbed activated charcoal, a cigarette filter, and a filter-tipped cigarette.

Description of the Related Art

In cigarettes, flavorants such as menthol are used to improve the intrinsic aroma and taste of the cigarettes. As menthol flavoring method, the addition to cut tobacco, the addition to inner packing paper of a package, and the addition to a filter are known. Encapsulation of menthol is also a common practice.

It is known that, in the addition of menthol to cut tobacco or inner packing paper, if the amount of menthol is increased, more brown stains occur on the cigarette paper of the tobacco rod during storage of the cigarette. The stains are attributable to the release of dyestuffs from cut tobacco upon the volatilization of menthol.

On the other hand, the use of menthol capsules allows the control of the occurrence of stains on cigarette paper and the deterioration of menthol in smoke. However, the use of menthol capsules requires the processes of the production of the capsules and incorporation of the capsules into the cigarette. As a result, the production cost of cigarette will increase.

On the other hand, U.S. Pat. No. 3,236,244 describes a filter element containing activated charcoal. Menthol is adsorbed to the activated charcoal, to add to a tobacco flavor.

BRIEF SUMMARY OF THE INVENTION

The present invention is intended to provide menthol-sorbed activated charcoal with stably holds the menthol during storage and smoothly releases the menthol only during passage of tobacco smoke therethrough, as well as a cigarette filter containing the menthol-sorbed activated charcoal.

The present invention is also intended to provide a cigarette which comprises the filter, stably holds the menthol during storage over time in the menthol-sorbed activated charcoal of the filter, smoothly releases menthol only when tobacco smoke passes through the filter during smoking, and reduces the occurrence of stains on the cigarette paper.

A first aspect of the present invention provides menthol-sorbed activated charcoal comprising activated charcoal having a specific surface area of 1500 $m^2/g$ or more but 1700 $m^2/g$ or less as measured by the BET method, with menthol being sorbed to the activated charcoal at a sorption rate of 80% or more but 92% or less with reference to the saturated amount of menthol for the activated charcoal.

The activated charcoal has a relatively large specific surface area, and has a relatively high degree of activity. Therefore, the activated charcoal is hereinafter referred to as "highly activated charcoal", thereby differentiating it from general activated charcoal.

A second aspect of the present invention provides a cigarette filter containing the menthol-sorbed activated charcoal of the first aspect.

A third aspect of the present invention provides a filter-tipped cigarette comprising the cigarette filter of the second aspect.

DETAILED DESCRIPTION OF THE INVENTION

Figure 1:
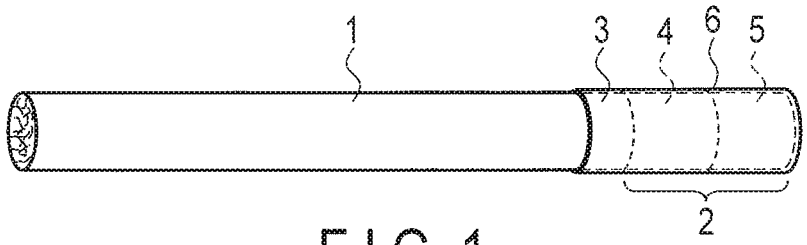
FIG. 1 shows a filter-tipped cigarette according to one embodiment of the present invention.

Embodiments of the present invention are described below in detail.

A menthol-sorbed activated charcoal according to an embodiment of the present invention comprises highly activated charcoal having a specific surface area of 1500 $m^2/g$ or more but 1700 $m^2/g$ or less as measured by the BET method, and to the charcoal, menthol is sorbed at a sorption rate of 80% or more but 92% or less with respect to the saturated amount of menthol for the highly activated charcoal.

The specific surface area by the BET method may be measured as follows:

Apparatus: Autosorb-1-MP (manufactured by Quantachrome)

Pretreatment: 0.010 g of activated charcoal sample for measurement was heated for 15 hours in a vacuum at 0.1 Pa and 573 K, Measurement method: the specific surface area of the pretreated sample was calculated by the Multipoint BET method at relative pressure P/P0=0.1 to 0.3 using the nitrogen adsorption isotherm data obtained at a temperature of 77 K.

The highly activated charcoal may be any activated charcoal as long as it has a specific surface area of 1500 $m^2/g$ or more but 1700 $m^2/g$ or less as measured by the BET method. As the highly activated charcoal, for example, coconut shell activated charcoal may be used.

An activated charcoal having a specific surface area of less than 1500 $m^2/g$ decreases in the amount of menthol held in the activated charcoal in the filter-tipped cigarette. As a result, it becomes difficult to sufficiently increase the amount of menthol in tobacco smoke during smoking. On the other hand, an activated charcoal having a specific surface area of more than 1700 $m^2/g$ may rapidly decrease in the percentage of reduction of menthol during storage.

The highly activated charcoal preferably has an average particle size of 200 to 600 μm.

When used in a filter-tipped cigarette, the sorption rate of menthol for the highly activated charcoal is important for the relationship between the lapsed days of storage and the amount of menthol in tobacco smoke during smoking. If the sorption rate of menthol is less than 80% with reference to the saturated amount of menthol for the highly activated charcoal, the amount of menthol held by the highly activated charcoal decreases when the charcoal is applied to a filter-tipped cigarette. As a result, it becomes difficult to sufficiently increase the amount of menthol in tobacco smoke during smoking. On the other hand, if the sorption rate of menthol is more than 92% with reference to the saturated amount of menthol for the highly activated charcoal, the amount of menthol in tobacco smoke during smoking may decrease with the lapsed days of storage.

The menthol-sorbed activated charcoal according to one embodiment can be produced by, for example, charging desired amounts of menthol and highly activated charcoal, which has a specific surface area of 1500 $m^2/g$ or more but 1700 $m^2/g$ or less as measured by the BET method, into the chamber of a rotary stirring apparatus, and allowing the menthol to be sorbed to the highly activated charcoal while rotating the highly activated charcoal. The chamber may be heated to an internal temperature of 40 to 80° C.

Next, a cigarette filter according to an embodiment will be described.

The cigarette filter according to an embodiment contains the menthol-sorbed activated charcoal described above.

In one embodiment, the cigarette filter has two or more segments and contains the menthol-sorbed activated charcoal in a part thereof. In another embodiment, the cigarette filter has a structure that many particles of the menthol-sorbed activated charcoal are filled between two columnar filter materials and a plug wrapper wraps the filter materials, including the filled portion.

The filter material is a filter material used in ordinary cigarette filters. For example, tow of cellulose acetate fibers may be used. The bundle of cellulose acetate fibers can be consolidated by the treatment with triacetin.

Next, a filter-tipped cigarette according to an embodiment of the present invention will be described.

The filter-tipped cigarette according to an embodiment includes the above-described cigarette filter.

In one embodiment, the filter-tipped cigarette has the structure shown in FIG. 1. The filter-tipped cigarette includes a tobacco rod 1, and a filter 2 having a perimeter equal to or less than that of the tobacco rod 1. The tobacco rod 1 and the filter 2 are butted with each other at their ends, and the whole circumference surface of the filter 2 and the circumference surface of the tobacco rod 1 near the butted portion are wrapped by a tipping paper 3, thereby integrating the tobacco rod 1 with the filter 2. The tobacco rod 1 is formed by wrapping cut tobacco with cigarette paper to form a column. The filter 2 is a segmented filter in which a first filter material 4 and a second filter material 5, which is serially butted to the rear end of the filter material 4, are wrapped with a plug wrapper 6 to form a column. The first filter material 4 is made by, for example, raveling cellulose acetate fiber bundle, uniformly dispersing many particles of the menthol-sorbed activated charcoal into the raveled cellulose acetate fibers, and then binding the fibers together to form a column. The second filter material 5 is made by, for example, raveling cellulose acetate fiber bundle, and then binding the fibers together to form a column. The first filter material 4, in which the menthol-sorbed activated charcoal is dispersed is located at the tobacco rod 1 side.

The filter will not be limited to the structure shown in FIG. 1. The filter may have a structure made of two filter materials opposed to each other with their ends apart from each other at a desired distance, many particles of menthol-sorbed activated charcoal filled between the two filter materials, and a plug wrapper wrapping the two filter materials and the filling of menthol-sorbed activated charcoal to form a column. The two filter materials are made by, for example, raveling acetate fiber bundles, and then binding the fibers together to form a column.

The above-described menthol-sorbed activated charcoal according to one embodiment has a constitution that to the highly activated charcoal having a specific surface area of 1500 $m^2/g$ or more but 1700 $m^2/g$ or less as measured by the BET method, menthol is sorbed at a sorption rate of 80% or more but 92% or less with reference to the saturated amount of menthol for the highly activated charcoal. Therefore, menthol is stably held during storage, and menthol is smoothly released only during the passage of tobacco smoke through the charcoal.

By causing the menthol-sorbed activated charcoal to be contained in a filter, and applying this filter into a filter-tipped cigarette, menthol is stably held over time in the menthol-sorbed activated charcoal in the filter during storage, menthol is smoothly released only when tobacco smoke passes through the filter during smoking, and the occurrence of stains on the cigarette paper is reduced. These were confirmed by the following tests.

<Test I>

Coconut shell activated charcoals having specific surface areas of 700, 1000, 1700, and 2000 $m^2/g$ as measured by the BET method and an average particle size of 400 μm (four prototypes prepared by changing the specific surface area of Kuraraycoal GGS manufactured by Kuraray Chemical Co., Ltd., through the change of the activation conditions) were provided. A menthol flavorant (manufactured by Fuji Flavor Co., Ltd.) was sorbed to the coconut shell activated charcoal to saturation, thereby preparing four types of menthol-sorbed activated charcoals.

50 mg of the particles of the menthol-sorbed activated charcoal thus obtained was dispersed in one of two cellulose acetate filter materials. These two filter materials were wrapped with a plug wrapper to form a column, thereby making a segmented filter. This filter was butted to the end of a tobacco rod (without menthol flavoring) such that the filter material containing the menthol-sorbed activated charcoal particles was positioned at the tobacco rod side. Subsequently, the whole circumference surface of the filter and the circumference surface of the tobacco rod near the butted portion were wrapped by a tipping paper. Thus, four types of filter-tipped cigarettes were fabricated.

The amount of menthol in tobacco smoke during smoking of the filter-tipped cigarettes thus obtained, in the initial stage (without storage), was measured by the following method, thereby examining the menthol releasability. In addition, the amount of menthol in tobacco smoke during smoking after storage for 0.5, 1.5, and 2.5 months was measured by the following method, and the amount of menthol (relative value) with reference to the value after storage for 0.5 month was determined. Furthermore, the rate of occurrence of stains on the cigarette paper was studied by the following method.

(Measurement of the Amount of Menthol)

The filter-tipped cigarette in the initial stage after production, and the filter-tipped cigarettes after storage for 0.5, 1.5, and 2.5 months were burned using an automatic smoking machine at a puff volume of 35 mL/2 sec, a puff interval of 60 seconds, and a burning length of 35 mm from the tip of mouthpiece. During burning, the particle phase components in the tobacco smoke were collected using a Cambridge Filter. The components thus obtained were solvent-extracted with methanol, and then subjected to gas chromatography, thereby quantitatively determining the amount of menthol in tobacco smoke.

(The Rate of Occurrence of Stains on Cigarette Paper)

The filter-tipped cigarettes were stored for 1 month in a constant temperature and humidity bath at a temperature of 22° C. and a relative humidity of 60%. Thereafter, stains appeared on the cigarette paper of the tobacco rod were visually observed, and the rate of occurrence of stains was determined. The stain with a size of 0.9 to 1.8 mm as measured by visual observation was rated as "small stain", and that with a size of greater than 1.8 mm as measured by visual observation was rated as "large stain".

Figure 2:
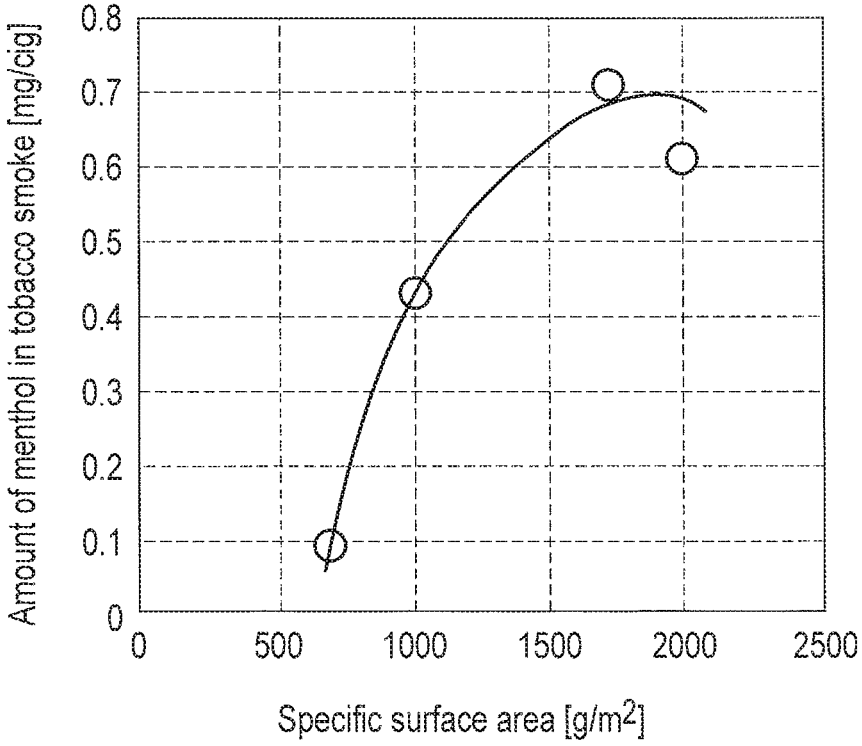
FIG. 2 shows a relationship between the specific surface area of the activated charcoal in the menthol-sorbed activated charcoal of a filter-tipped cigarette and the amount of menthol in tobacco smoke in the initial stage (without storage).
Figure 3:
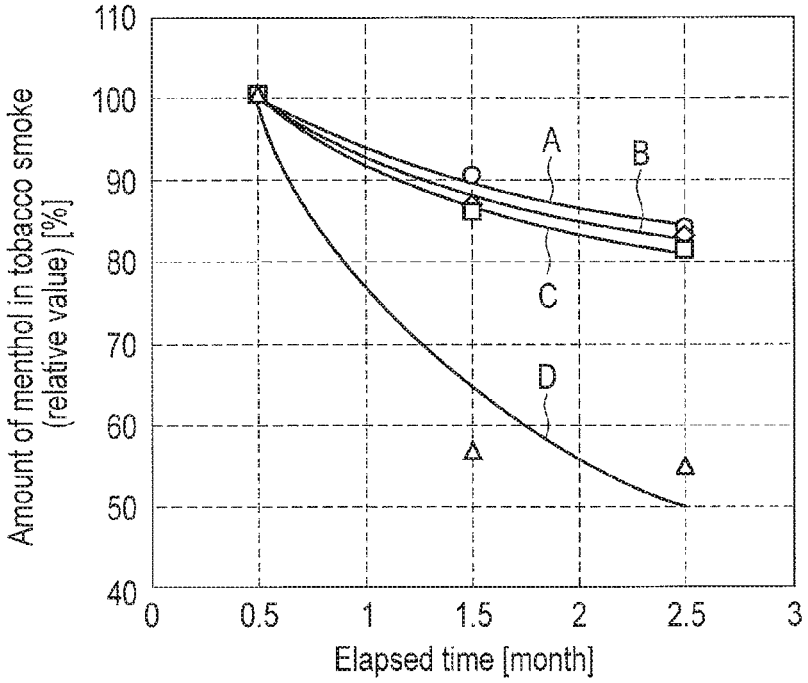
FIG. 3 shows the amount of menthol (relative value) in tobacco smoke during smoking after storage of a filter-tipped cigarette for 0.5, 1.5, and 2.5 months.
Figure 4:
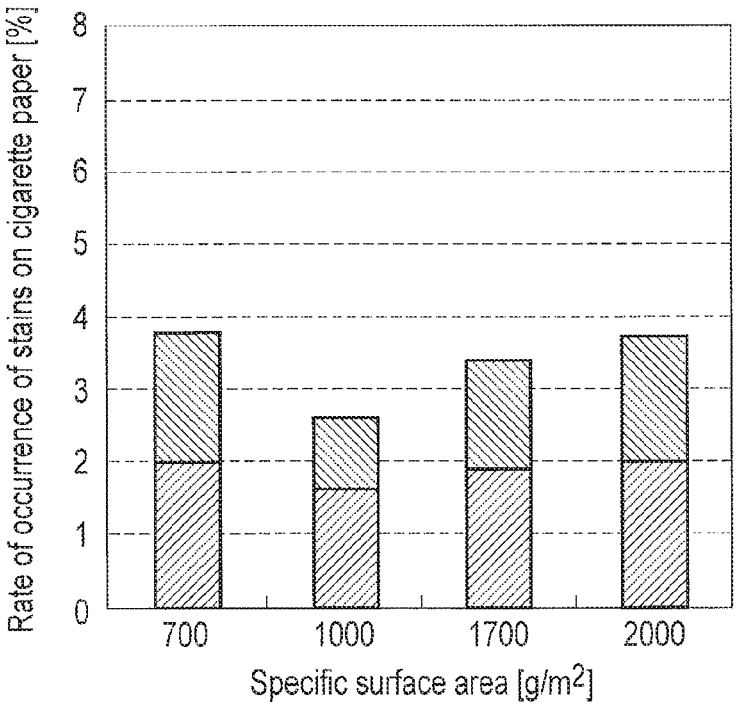
FIG. 4 shows a relationship between the specific surface area of the activated charcoal in the menthol-sorbed activated charcoal of a filter-tipped cigarette and the rate of occurrence of stains on the cigarette paper.

FIG. 2 shows the amount of menthol in tobacco smoke during smoking in the initial stage (without storage) of the filter-tipped cigarettes. FIG. 3 shows the amount of menthol (relative value). FIG. 4 shows the rate of occurrence of stains on the cigarette paper. In FIG. 3, curve A shows the relationship between the lapsed days of storage of the cigarette tipped with the filter incorporating the menthol-sorbed activated charcoal made from coconut shell activated charcoal having a specific surface area of 700 $m^2/g$ and the rate of menthol decrease. Curve B shows the relationship between the lapsed days of storage of the cigarette tipped with the filter incorporating the menthol-sorbed activated charcoal made from coconut shell activated charcoal having a specific surface area of 1000 $m^2/g$ and the rate of menthol decrease. Curve C shows the relationship between the lapsed days of storage of the cigarette tipped with the filter incorporating the menthol-sorbed activated charcoal made from coconut shell activated charcoal having a specific surface area of 1700 $m^2/g$ and the rate of menthol decrease. Curve D shows the relationship between the lapsed days of storage of the cigarette tipped with the filter incorporating the menthol-sorbed activated charcoal made from coconut shell activated charcoal having a specific surface area of 2000 $m^2/g$ and the rate of menthol decrease. In FIG. 4, the upper part of the bars represents "large stain", and the lower part represents "small stain".

As is evident from FIG. 2, the cigarettes tipped with the filters incorporating the menthol-sorbed activated charcoal comprising activated charcoal having a specific surface area of 1500 to 1700 $m^2/g$ as measured by the BET method release a greater amount of menthol in tobacco smoke during smoking than the cigarettes tipped with the filters incorporating the menthol-sorbed activated charcoal comprising activated charcoal having a specific surface area of less than 1500 $m^2/g$, and thus exhibited higher menthol releasability. However, it is seen that there is little increase in the amount of menthol in tobacco smoke released during smoking of the cigarettes tipped with the filters incorporating the menthol-sorbed activated charcoal comprising activated charcoal having a specific surface area of more than 1700 $m^2/g$.

On the other hand, as is evident from FIG. 3, the change in menthol releasability over time (the decrease in the amount of menthol) was almost the same among the cigarettes tipped with the filters incorporating the menthol-sorbed activated charcoal comprising highly activated charcoal having a specific surface area of 700 to 1700 $m^2/g$. However, the amount of menthol (relative value) released from the cigarette tipped with the filter incorporating the menthol-sorbed activated charcoal comprising activated charcoal having a specific surface area of more than 1700 $m^2/g$ (2000 $m^2/g$) rapidly increased (curve D).

Furthermore, as is evident from FIG. 4, the rate of occurrence of stains on the cigarette paper of the tobacco rod was equal independent of the specific surface area of activated charcoal in the menthol-sorbed activated charcoal.

Based on the above results of Test I, it was found that the use of the filter containing menthol-sorbed activated charcoal with highly activated charcoal having a specific surface area of 1500 $m^2/g$ or more but 1700 $m^2/g$ or less as measured by the BET method is suitable for the achievement of a filter-tipped cigarette which shows a little change in menthol over time and a low rate of occurrence of stains on cigarette paper during storage, while realizing a high releasability of menthol.

<Test II>

Coconut shell activated charcoal having a specific surface area of 1700 $m^2/g$ as measured by the BET method and an average particle size of 400 μm (prototype prepared by changing the specific surface area of Kuraraycoal GGS manufactured by Kuraray Chemical Co., Ltd., through the change of the activation conditions) was provided. A menthol flavorant (manufactured by Fuji Flavor Co., Ltd.) was sorbed to the coconut shell activated charcoal at the sorption rates of 80 to 100% with reference to the saturated amount of menthol for the coconut shell activated charcoal, thereby preparing six particulate menthol-sorbed activated charcoals. The saturated amount of menthol for the coconut shell activated charcoal having a specific surface area of 1700 $m^2/g$ as measured by the BET method and an average particle size of 400 μm is 60 parts by weight of menthol with reference to 100 parts by weight of activated charcoal. Therefore, the sorption rate was defined as follows: activated charcoal:menthol=100:48 to 60.

Figure 5:
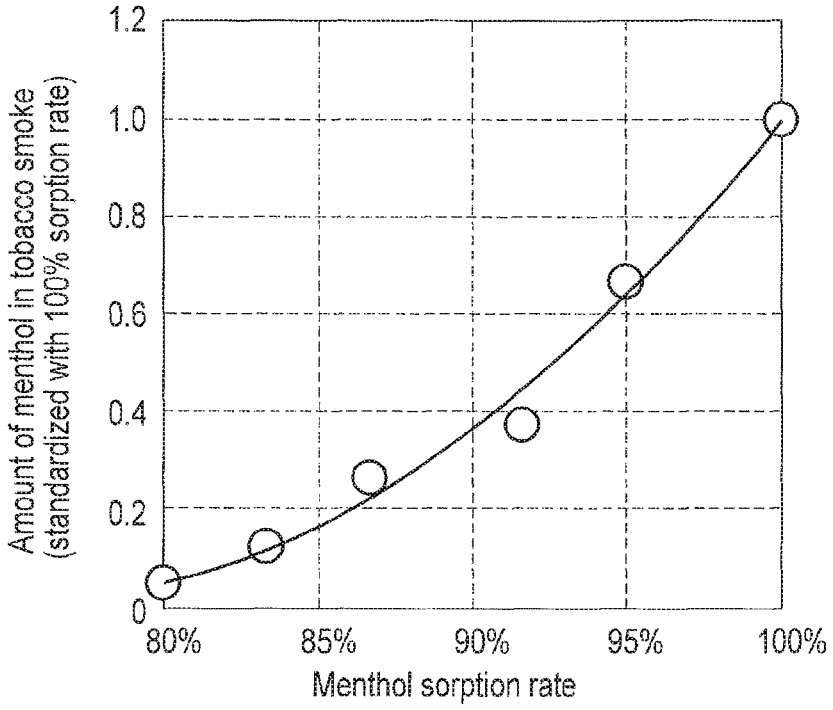
FIG. 5 shows a relationship between the menthol sorption rate for the menthol-sorbed activated charcoal in a filter-tipped cigarette and the amount of menthol in tobacco smoke during smoking.

Filter-tipped cigarettes were made using the menthol-sorbed activated charcoal obtained above in the same manner as in Test I. The amount of menthol in tobacco smoke during smoking released from the filter-tipped cigarettes in the initial stage (without storage) was measured in the same manner as in Test I. The results are shown in FIG. 5. The amount of menthol on the ordinate in FIG. 5 was standardized with the amount of menthol from the cigarette including the menthol-sorbed activated charcoal having a sorption rate of 100% as 1.

As is evident from FIG. 5, the amount of menthol in tobacco smoke during smoking increased as the sorption rate of the menthol-sorbed activated charcoal approached 100%, and the menthol was hardly released during smoking when the menthol-sorbed activated charcoal having a sorption rate of less than 80% was used.

<Test III>

Coconut shell activated charcoal having a specific surface area of 1700 $m^2/g$ as measured by the BET method and an average particle size of 400 μm (prototype prepared by changing the specific surface area of Kuraraycoal GGS manufactured by Kuraray Chemical Co., Ltd., through the change of the activation conditions) was provided. A menthol flavorant (manufactured by Fuji Flavor Co., Ltd.) was sorbed to the coconut shell activated charcoal at sorption rates of 92, 95, and 100% with reference to the saturated amount of menthol for the coconut shell activated charcoal, thereby preparing three particulate menthol-sorbed activated charcoal.

Figure 6:
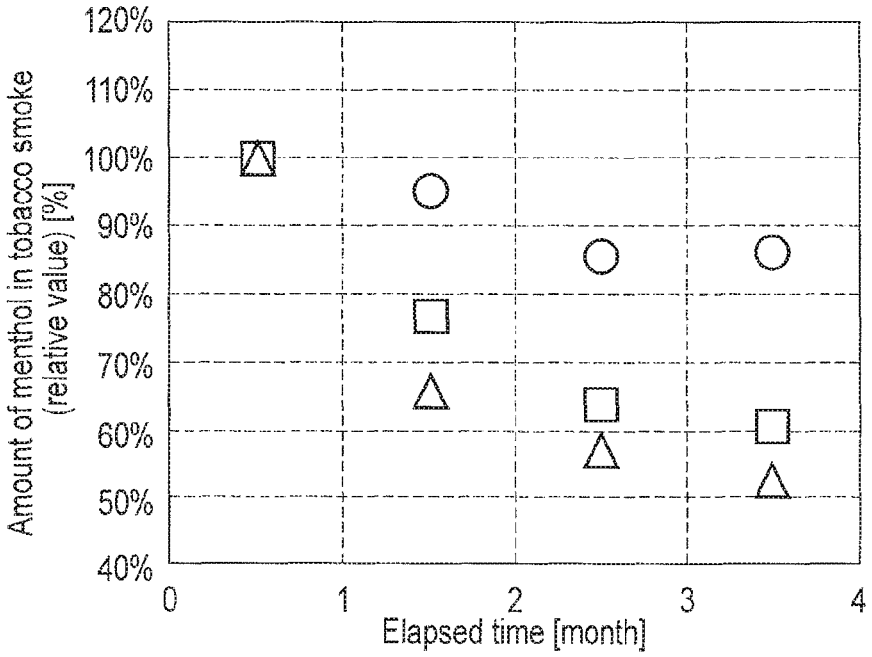
FIG. 6 shows a relationship between the menthol sorption rate for the menthol-sorbed activated charcoal in a filter-tipped cigarette and the amount of menthol (relative value) in tobacco smoke during smoking after storage under high temperature conditions (maximum temperature 55° C., humidity 35% RH) for 0.5, 1.5, 2.5, and 3.5 months.

Filter-tipped cigarettes were made using the menthol-sorbed activated charcoal obtained above, in the same manner as in Test I. These filter-tipped cigarettes were measured for the amount of menthol in tobacco smoke during smoking after storage for 0.5, 1.5, 2.5, and 3.5 months under high temperature conditions (maximum temperature 55° C., humidity 35% RH) in the same manner as in Test I, and the amount of menthol (relative value) was determined, setting the value after storage for 0.5 month as 100%. The results are shown in FIG. 6. In FIG. 6, ○ represents the change in the amount of menthol (relative value) over time in tobacco smoke from the cigarette containing menthol-sorbed activated charcoal having a sorption rate of 92%, □ represents the change in the amount of menthol (relative value) over time in tobacco smoke from the cigarette containing menthol-sorbed activated charcoal having a sorption rate of 95%, and Δ represents the change in the amount of menthol (relative value) over time in tobacco smoke from the cigarette containing menthol-sorbed activated charcoal having a sorption rate of 100%.

As is evident from FIG. 6, in the cigarettes including the menthol-sorbed activated charcoal having sorption rates of 95 and 100%, the amount of menthol in tobacco smoke during smoking after storage for 3½ months under the high temperature conditions was 60 and 50% with reference to that after storage for 0.5 month, indicating that menthol in tobacco smoke markedly deteriorates over time.

On the other hand, it is seen that in the cigarette including the menthol-sorbed activated charcoal having a sorption rate of 92%, the amount of menthol in tobacco smoke was kept at about 85% even after storage for 3.5 months under the high temperature conditions with reference to the amount of menthol in tobacco smoke during smoking at the time of 0.5 month storage.

Based on the above results of Tests II and III, it was found that the use of the filter containing the menthol-sorbed activated charcoal in which menthol is sorbed to highly activated charcoal having a specific surface area at a sorption rate of 80% or more and 92% or less with reference to the saturated amount of menthol for the highly activated charcoal is suitable for providing a filter-tipped cigarette which shows a little change in menthol over time during storage, which realizing a high releasability of menthol.

Examples of the present invention are described below.

Example 1

Coconut shell activated charcoal having a specific surface area of 1700 $m^2/g$ as measured by the BET method and an average particle size of 400 μm (prototype prepared by changing the specific surface area of Kuraraycoal GGS manufactured by Kuraray Chemical Co., Ltd., through the change of the activation conditions) was provided. A menthol flavorant (manufactured by Fuji Flavor Co., Ltd.) was sorbed to the coconut shell activated charcoal at a sorption rate of 92% with reference to the saturated amount of menthol for the coconut shell activated charcoal, thereby preparing particulate menthol-sorbed activated charcoal. The saturated amount of menthol for the coconut shell activated charcoal having a specific surface area of 1700 $m^2/g$ as measured by the BET method and an average particle size of 400 μm is 60 parts by weight of menthol with reference to 100 parts by weight of activated charcoal. Therefore, the sorption rate of 92% was achieved using 100 parts by weight of activated charcoal and 55 parts by weight of menthol.

A filter-tipped cigarette was made using 160 mg of the menthol-sorbed activated charcoal thus obtained, in the same manner as in Test I.

Comparative Example 1

A filter-tipped cigarette was made in the same manner as in Test I, except that 4.0 mg of menthol was sorbed to the cut tobacco in the tobacco rod, instead of placing the menthol-sorbed activated charcoal in the filter.

The filter-tipped cigarettes of Example 1 and Comparative Example 1 were measured for the amount of menthol in tobacco smoke during smoking in the initial stage after production (without storage), in the same manner as in Test I. As a result, the amount of menthol in tobacco smoke from the cigarette of Example 1 was 0.41 mg/cig, and the amount of menthol in tobacco smoke from the cigarette of Comparative Example 1 was 0.4 mg/cig.

Figure 7:
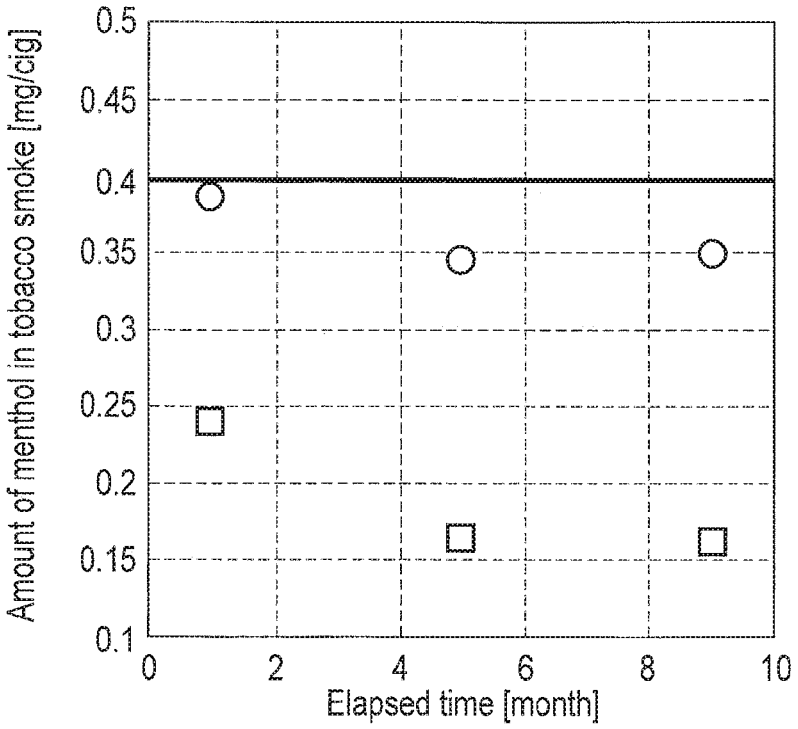
FIG. 7 shows the amount of menthol in tobacco smoke during smoking of the filter-tipped cigarettes of Example 1 and Comparative Example 1 after storage under high temperature conditions (maximum temperature 55° C., humidity 35% RH) for 1, 5, and 9 weeks.

Furthermore, the filter-tipped cigarettes of Example 1 and Comparative Example 1 were measured for the amount of menthol in tobacco smoke during smoking after storage for 1, 5, and 9 weeks under high temperature conditions (maximum temperature 55° C., humidity 35% RH), in the same manner as in Test I. The results are shown in FIG. 7. In FIG. 7, ○ represents the change over time in the amount of menthol in tobacco smoke from the cigarette of Example 1, and □ represents the change over time in the amount of menthol in tobacco smoke from the cigarette of Comparative Example 1.

As is evident from FIG. 7, the cigarette of Example 1 showed a significantly smaller change over time in the amount of menthol in tobacco smoke in comparison with the cigarette of Comparative Example 1.

Figure 8:
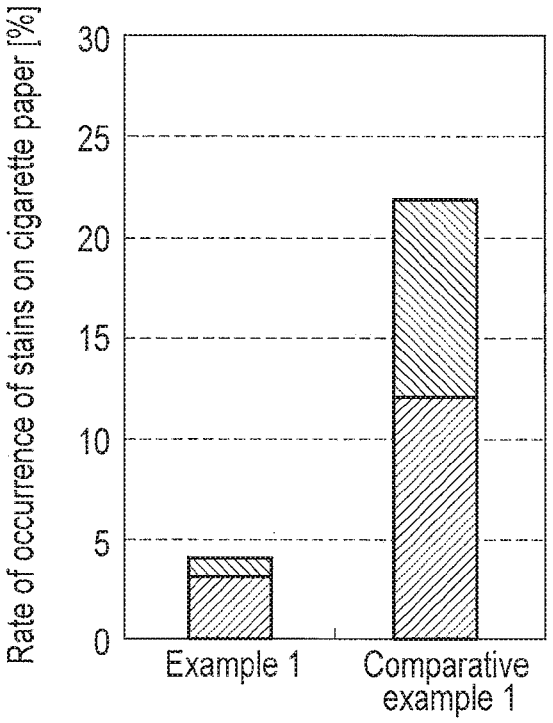
FIG. 8 shows the rate of occurrence of stains on the cigarette paper of the filter-tipped cigarettes of Example 1 and Comparative Example 1.

Furthermore, the filter-tipped cigarettes of Example 1 and Comparative Example 1 were stored in a constant temperature and humidity bath at a temperature of 22° C. and a relative humidity of 60% for one month, and stains occurred on the cigarette paper of the tobacco rod were visually observed, and the rate of occurrence of stains was determined. The stain with a size of 0.9 to 1.8 mm as measured by visual observation was rated as "small stain", and that with a size of greater than 1.8 mm as measured by visual observation was rated as "large stain". The results are shown in FIG. 8. In FIG. 8, the upper part of the bars represents "large stain", and the lower part represents "small stain".

As is evident from FIG. 8, the cigarette of Example 1 showed a significantly lower rate of occurrence of stains on the cigarette paper of the tobacco rod than that of the cigarette of Comparative Example 1.

Example 2

The same menthol-sorbed activated charcoal (sorption rate 92%) as in Example 1 was provided, and a filter-tipped cigarette was made in the same manner as in Test I using 80 mg of the menthol-sorbed activated charcoal.

Comparative Example 2

A filter-tipped cigarette was made in the same manner as in Test I, except that 6.0 mg of menthol was sorbed to the cut tobacco in the tobacco rod, instead of placing menthol-sorbed activated charcoal in the filter.

The filter-tipped cigarettes of Example 2 and Comparative Example 2 were stored for 1.5 months in a constant temperature and humidity bath at a temperature of 22° C. and a relative humidity of 60%, and then the change in the amount of menthol by the puff number was measured by the following method.

Figure 9:
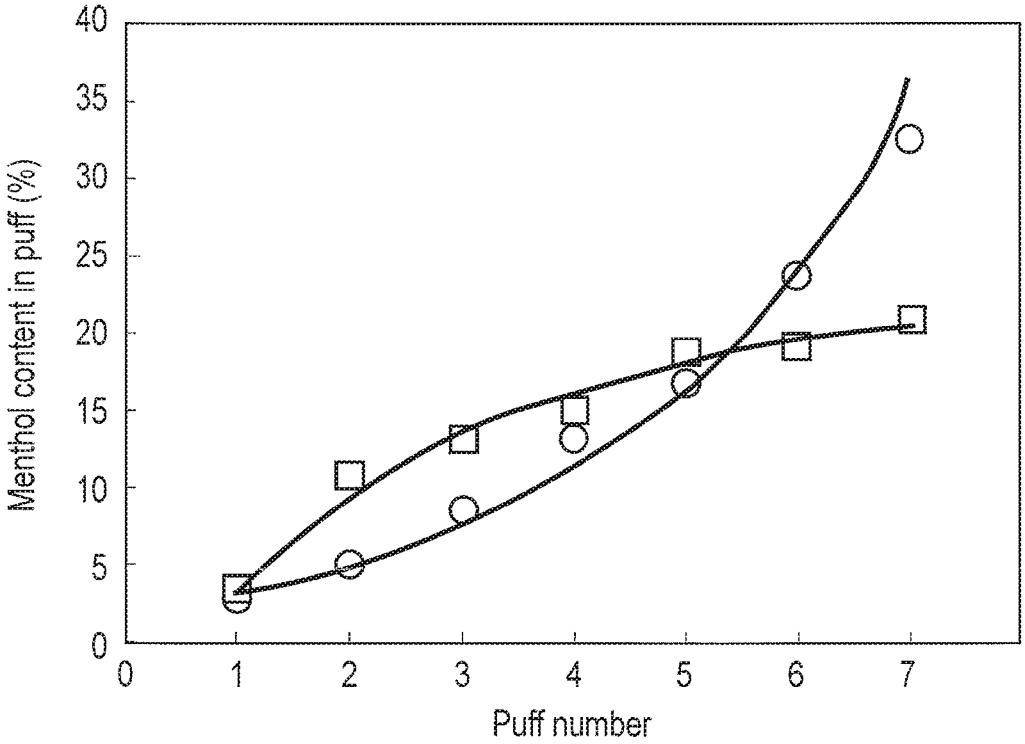
FIG. 9 shows the change in the menthol content in each puff of the cigarettes of Example 2 and Comparative Example 2.

More specifically, the filter-tipped cigarette after storage was mounted on an automatic smoking machine, puffed for 2 seconds, and the particle phase components in the puff were collected using Cambridge Filter. The component thus obtained was extracted with a methanol solvent, and then subjected to gas chromatography, thereby determining the amount of menthol in the puff. The puffing was performed seven times in total at intervals of one minute, and the amount of menthol in each puff was determined. The menthol ratio (%) in each puff was determined by summing the amount of menthol in the first to seventh puffs, and dividing the amount of menthol in each puff with the total amount of menthol. The results are shown in FIG. 9. In FIG. 9, ○ represents the change in the ratio of menthol by the puff number of the cigarette of Example 2, and □ represents the change in the ratio of menthol by the puff number of the cigarette of Comparative Example 2.

As is evident from FIG. 9, the cigarette of Example 2 including the filter containing dispersed menthol-sorbed activated charcoal released menthol from the initial puff on the same level with the cigarette of Comparative Example 2 including menthol-sorbed cut tobacco. More specifically, since the cigarette of Comparative Example 2 includes menthol sorbed on cut tobacco, it efficiently releases menthol from the first puff, but stains occur on the cigarette paper at a high rate as shown by Comparative Example 1 in FIG. 8 described above. On the other hand, since the cigarette of Example 2 contains menthol-sorbed activated charcoal dispersed in the filter, it significantly decreases the rate of occurrence of stains on the cigarette paper of the tobacco rod, and efficiently releases menthol from the first puff on the same level as Comparative Example 2.

The present invention provides menthol-sorbed activated charcoal which stably holds menthol during storage and smoothly releases menthol only during passage of tobacco smoke, and a cigarette filter containing the menthol-sorbed activated charcoal.

The present invention also provides a filter-tipped cigarette which includes the filter, stably holds menthol over time during storage in the menthol-sorbed activated charcoal in the filter, smoothly releases menthol only when tobacco smoke passes through the filter during smoking, and reduces the occurrence of stains on the cigarette paper.

What is claimed is:

1. A method of producing a cigarette filter containing a menthol-sorbed activated charcoal, the method comprising:

adsorbing menthol on activated charcoal at a menthol sorption rate of 80% or more and 92% or less with reference to the saturated amount of menthol for the activated charcoal to prepare the menthol-sorbed activated charcoal, wherein the activated charcoal has a specific surface area of 1500 $m^2/g$ or more and 1700 $m^2/g$ or less as measured by the BET method; and incorporating the menthol-sorbed activated charcoal into a cigarette filter to produce the cigarette filter containing the menthol-sorbed activated charcoal.

2. The method according to claim 1, wherein the filter has two or more segments, and the menthol-sorbed activated charcoal is contained in a portion thereof.

3. The method of according to claim 1, wherein a material of the cigarette filter is a cellulose acetate material.

4. A method of producing a filter-tipped cigarette, the method comprising:

wrapping a cigarette filter produced by the method according to claim 1 and a tobacco rod comprising a tobacco filler in a tipping paper to connect them.

* * * * *